US005099784A

United States Patent [19]

Gross

[11] Patent Number: 5,099,784

[45] Date of Patent: Mar. 31, 1992

[54] CONTACT MARKER SYSTEM

[75] Inventor: Peter L. Gross, Indianapolis, Ind.

[73] Assignee: Ransburg Corporation, Indianapolis, Ind.

[21] Appl. No.: 607,909

[22] Filed: Nov. 1, 1990

[51] Int. Cl.[5] ..... B05C 1/00; B05C 1/02

[52] U.S. Cl. ..... 118/243; 118/211; 118/256; 118/263

[58] Field of Search ..... 118/243, 410, 256, 241, 118/263, 211; 15/210 B

[56] References Cited

U.S. PATENT DOCUMENTS 3,345,076 10/1967 Wheelock ..... 15/210 B
3,536,039 10/1970 Gardiner ..... 118/243
3,684,389 8/1972 Eron et al. ..... 401/207
5,015,505 5/1991 Cetnar ..... 110/410

*Primary Examiner*—Michael G. Wityshyn
*Assistant Examiner*—Brenda Lamb
*Attorney, Agent, or Firm*—Barnes & Thornburg

[57] ABSTRACT

A marking head for applying a marking composition to locations on elements. The marking head has a marking rod with a marking end and a motor for reciprocating the marking rod through a chamber filled with a marking fluid. The marking fluid is uniformly applied to the marking end of the marking rod by the use of a diffuser and a rod scaper each of which are positioned adjacent to the chamber filled with the marking fluid.

3 Claims, 1 Drawing Sheet

CONTACT MARKER SYSTEM

This invention relates to marking systems. While it is disclosed in the context of a weight correction marker for mounting on a rotary element imbalance determining apparatus, it is believed to be useful in other environments as well.

BACKGROUND OF THE INVENTION

During the process of correcting imbalance in tire/-wheel assemblies using high volume production equipment, it is necessary to put temporary marks on the assemblies showing where weight correction is to be effected. This is currently accomplished using a variety of systems that generally have been undependable, inaccurate, messy and otherwise unsatisfactory.

SUMMARY OF THE INVENTION

It is an object of the contact marking system of the present invention to provide improved apparatus for applying the temporary mark.

According to the invention, a marking head for marking the locations on elements at which correction is to be effected comprises a marker for dispensing a marking composition onto the location, a motor for projecting the marker into, and retracting the marker from, marking orientation, a body from which the marker is projected, and into which the marker is retracted, by the motor. The body includes a metering chamber through which a portion of the marker passes as the marker is projected from the body. The metering chamber contains the marking composition.

Illustratively, the marking head further comprises means for removing excess marking composition from the marker as the marker is projected from the body.

Additionally, illustratively, the marker comprises an end which is projected by the motor into marking orientation with the element to be marked. The end of the marker includes a portion configured for retaining an amount of the marking composition and for marking a wide range of different element types.

Further, illustratively, the motor comprises a piston and cylinder fluid motor. The marker comprises a rod coupled to the piston.

BRIEF DESCRIPTION OF THE DRAWINGS

The invention may best be understood by referring to the following description and accompanying drawings which illustrate the invention. In the drawings.

DESCRIPTION OF THE PREFERRED EMBODIMENTS OF THE INVENTION

Figure 1:
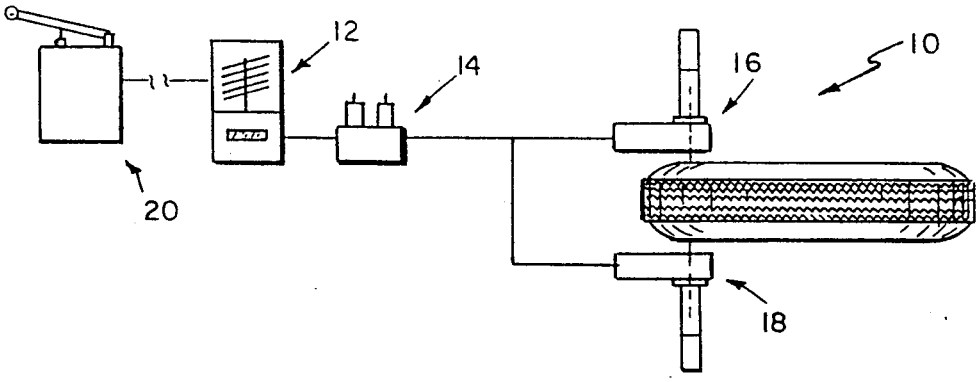
FIG. 1 illustrates a highly diagrammatic side elevational view of a system constructed according to the present invention.
Figure 3:
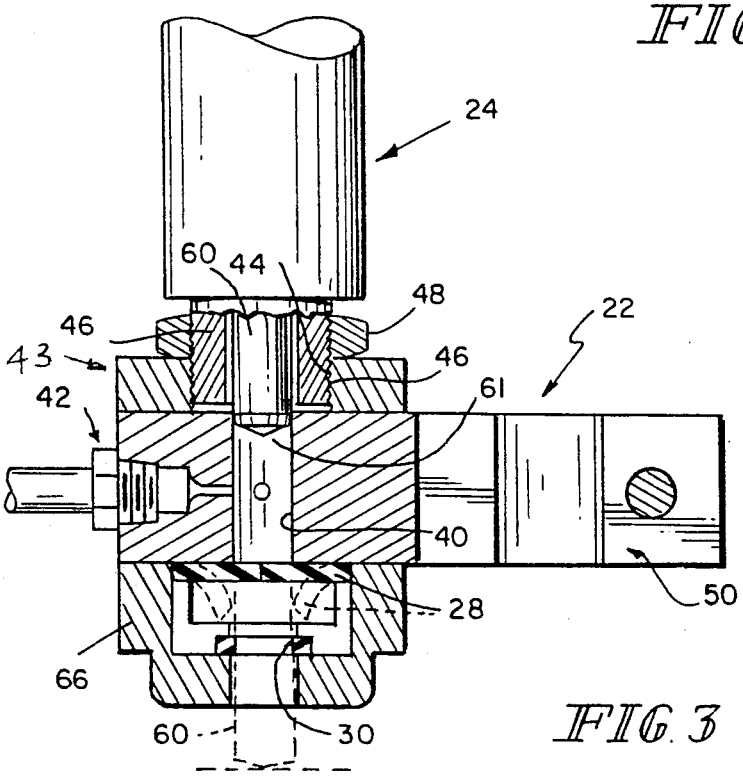
FIG. 3 illustrates a sectional side elevational view of the marking head of FIG. 2, taken generally along section lines 3—3 thereof.

The contact marking system 10 of the present invention comprises a distribution pump 12, metering units 14 for metering the marking composition to upper and lower marking heads 16, 18, respectively, a pneumatic actuating system, and a hand-operated refill reservoir 20.

The distribution Pump 12 illustratively is a Lincoln part number 83668, air operated, single stroke grease pump available from Lincoln, One Lincoln Way, St. Louis, Miss. 63120-1578. Pump 12 is a piston pump designed to hold a supply of marking agent and dispense it to the metering units 14 under high pressure (approx. 2400 p.s.i.g.). The distribution pump 12 is equipped with a low level sensing mechanism and stores, for example, four pounds of marking agent which is sufficient for up to 500,000 marks. One distribution pump 12 can supply multiple metering units 14. The metering units 14 illustratively are Lincoln Model SL-32 part number 83338 injectors which dispense very small amounts of marking agent each time the distribution pump 12 is cycled.

Marking heads 16, 18 are identical, and so only marking head 16 will be described in detail. The primary components of marking head 16 are a marker body 22, a marking cylinder 24, a diffuser 28, a rod scraper 30 and a proximity switch 62.

The marker body 22 contains a chamber 40 into which the marking agent is injected through a fitting coupled to a port 42. A steel cylinder mounting plate 43, which is attached to marker body 22 by cap screws 45 extending through marker body 22 from the side thereof opposite cylinder mounting plate 43, is threaded at 44 to receive the threaded end 46 of marking cylinder 24. Threaded end 46 is provided with a locking nut 48. Marker body 22 is also provided with a pair of ears 50 between which is defined a slot 52. Slot 52 opens about midway along its length into two half right circular cylindrical cutouts 56 which open toward each other. These cutouts 56 adjustably 58 receive a supporting rod (not shown) which extends from the framework of a tire/wheel assembly imbalance determining apparatus such as that described in, for example, U.S. Pat. No. 4,262,536.

One metering unit 14 is located at every marking head 16, 18 and the output of the respective metering unit 14 is directed into the chamber 40 through which the end 61 of the piston rod 60 of the marking cylinder 24 travels when the marking cylinder 24 is actuated. The output of the metering unit 14 is adjustable. The tip 61 of rod 60 is configured to be able to provide a visible mark at a selected area on the sidewall of a broad range of tire sizes and types.

The marking cylinder 24 illustratively is a Clippard Minimatic® Model 18SD-18 pneumatic cylinder, the end of the rod 60 of which is modified to produce a legible mark on a variety of tire contours and easily to enter and pass through the rod scraper 30. Illustratively, the tip 61 is conical in shape, sloping away from the rod 60 sidewall at an included angle of approximately one hundred ten degrees to the rod 60 sidewall. A slight draft of, for example, three degrees can be provided at the junction of the conical portion and sidewall. Illustratively, this draft extends back from the junction approximately one-eighth inch. This configuration aids the rod tip 61 in its passage through the rod scraper 30, and reduces wear on the rod scraper.

Figure 2:
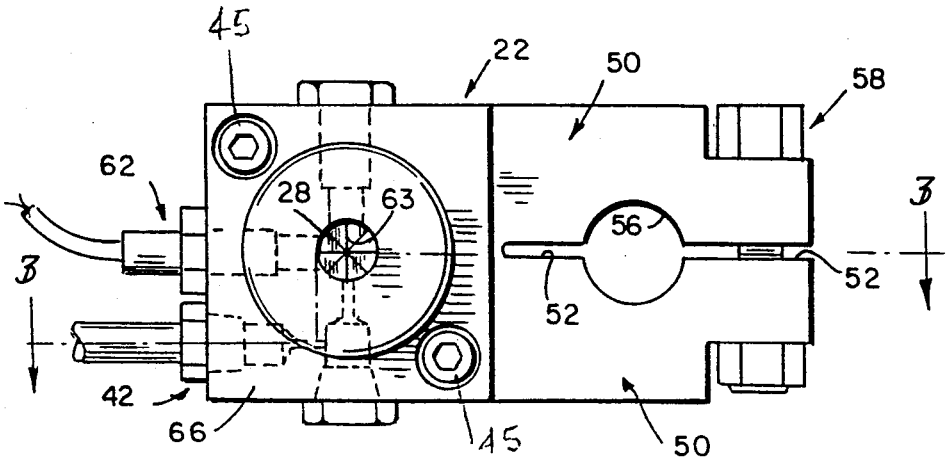
FIG. 2 illustrates a bottom plan view of a marking head constructed according to the present invention.

The diffuser 28 spreads the marking agent over the tip 61 of the rod 60 as the rod 60 passes through it. This prevents the marking agent from being concentrated in one area of the rod 60 tip 61. The diffuser 28 illustratively is made of polyurethane and has four intersecting slits 63 (FIG. 2) to allow the rod 60 to pass easily through the diffuser 28 and to provide long service life.

The rod scraper 30 removes excess marking agent from the rod 60, preventing an unacceptable amount of the marking agent from accumulating on the marking head 16 as the rod 60 is retracted. Rod scraper 30 illustratively is a Parker Model D-375 rod scraper.

An inductive proximity sensor 62, such as the Omron Model E2E-X2MY1 inductive proximity sensor is used to sense that the rod 60 is extended. The signal from the proximity switch 62 is employed as an interlock between the marking head 16 and other components of the imbalance determining machine.

The marker body 22 and the housing 66 for the diffuser 28 and rod scraper 30 are made from bearing materials to provide additional support for the rod 60 when it is extended. Illustratively, the material from which the marker body 22 and housing 66 are constructed is Nylatron ® GS nylon material available from Auburn Plastics, 4425 East 21st Street, Indianapolis, Indiana 46218.

The pneumatic actuating system comprises standard pneumatic components that are used to cycle the distribution pump and to extend and retract the marking cylinders. The marking cylinders are operated at low pressure, for example, 20 p.s.i.g., to prevent injury.

The refill equipment is standard, commercially available equipment. It comprises a pump which mount on standard 35 lb. metal lubricant containers and a high pressure hose with a quick connect coupling which attaches to the distribution pump.

A variety of marking agents can be utilized by this system, depending on the desired characteristics. One agent specifically developed for use in the described System is compound 294—B, —R, —W or —Y available from Crescent Oil Company, Inc., 514 West Wyoming Street, P.0. Box 1266, Indianapolis, Indiana 46206. This material comprises petrolatum and a pigment to make the agent relatively opaque. The petrolatum helps to keep the pigment suspended and to prevent the mark from being washed off during, for example, vehicle wheel and tire assembly air leakage testinq processes. The petrolatum is also tacky enough to adhere when applied to tires coated with common lubricants used in the mounting process and to withstand the centrifugal force generated during dynamic imbalance measurement. This marking agent initially can be wiped off easily if desired. If left on the tire for extended periods, a Petroleum-based solvent may be required to remove it.

The sequence of operation of the contact marking system 10 begins when air is applied to the distribution pump 12, causing the pump 12 to discharge marking agent under high pressure to the metering unit(s) 14 located at the marking head(s) 16, 18. Air pressure is then removed from the distribution pump 12, allowing the metering unit(s) 14 to complete its (their) cycle(s). The metering unit(s) 14 discharge (a) small amount(s) of marking agent into the chamber(s) 40 in the marker body(ies) 22. When a mark is desired, air is applied to the marking cylinder 24, causing its rod 60 to project from the marking cylinder 24. As the rod 60 is projected through the chamber 40 in the marker body 22 its tip 61 picks up the marking agent. The rod 60 passes through the diffuser 28, which spreads the marking agent over the tip 61 of the rod 60. The rod 60 next projects through the scraper 30 which removes excess marking agent from the rod 60 and retains it inside the marking head 16, 18. The rod 60 continues to extend from the marking cylinder 24 until it comes into contact with the tire, stalls and deposits a mark of the marking agent on the tire. The rod 60 is then retracted, preparing the contact marking system 10 for its next cycle of operation.

What is claimed is:

1. A marking head (16, 18) for the marking with a marking fluid of locations on elements at which correction is to be effected, the marking head comprising a chamber (40) into which an amount of the fluid suitable for marking a mark is metered, a marking rod (60) having a marking end (61) formed thereon, a motor (24) for reciprocating the marking rod (60) through the chamber (40) to convey said amount of fluid from the chamber (40) on said marking end (61), and a diffuser (28) positioned adjacent the chamber (40) to distribute said amount of fluid more uniformly across said marking end (61), projection of the marking end (61) through the chamber (40), then the diffuser (28), then into contact with said locations causing marks of substantially said amount to be deposited at said locations.

2. The marking head (16, 18) of claim 1 and further comprising a rod scraper (30) for scraping excess amounts of said marking fluid from said rod (60) adjacent said marking end (61), and means (66) for mounting the rod scraper (30) so that the marking end (61) passes through the diffuser (28), then through the rod scraper (30), then deposits a mark at a said location.

3. The marking head of claim 1 wherein the marking end (61) comprises a shallow, convex conical surface.

* * * * *